United States Patent [19]

Spears

[11] 4,277,849

[45] Jul. 14, 1981

[54] ELONGATE GARMENT FOR WOMEN AND GIRLS

[76] Inventor: Leslie G. Spears, 70, Church St., Chesham, Buckinghamshire, England

[21] Appl. No.: 119,934

[22] Filed: Feb. 8, 1980

[51] Int. Cl.[3] ..... A41D 25/00

[52] U.S. Cl. ..... 2/144; 2/207; 2/300

[58] Field of Search ..... 2/144, 145, 207, 91, 2/150, 300

[56] References Cited

U.S. PATENT DOCUMENTS

| | | | |
|---|---|---|---|
| 1,095,740 | 5/1914 | Seidman | 2/144 |
| 2,343,515 | 3/1944 | Lonk | 2/146 |
| 3,605,121 | 9/1971 | Suzuki | 2/207 |

FOREIGN PATENT DOCUMENTS

| | | | |
|---|---|---|---|
| 889186 | 2/1943 | France | 2/144 |
| 370163 | 4/1932 | United Kingdom . | |
| 491899 | 9/1938 | United Kingdom . | |
| 577959 | 6/1946 | United Kingdom . | |
| 668240 | 3/1952 | United Kingdom . | |
| 967231 | 8/1964 | United Kingdom . | |

*Primary Examiner*—Doris L. Troutman
*Attorney, Agent, or Firm*—Robert L. Goldberg

[57] ABSTRACT

An elongate garment for women and girls has an intermediate section of constant width and two outer sections which are of different shape. The outer sections increase in width initially as they extend away from the intermediate section and are of different lengths. The length of the intermediate section is at least 29% of the overall length of the garment. The garment has an overall length of 25" to 70" and an overall width of $\frac{5}{8}$" to $8\frac{1}{2}$".

4 Claims, 10 Drawing Figures

ELONGATE GARMENT FOR WOMEN AND GIRLS

FIELD OF THE INVENTION

This invention relates to a garment for women and girls.

BACKGROUND OF THE INVENTION

British Pat. No. 491,899 discloses a neck-tie normally intended for wear by men comprising an intermediate section and two outer sections.

OBJECT OF THE INVENTION

It is an object of the invention to provide a garment for women and girls having an intermediate section and two outer sections capable of many uses.

SUMMARY OF THE INVENTION

According to this invention there is provided a garment for women and girls which is elongate and has an intermediate section of constant width and two outer sections which are of different shape, the outer sections increasing in width initially as they extend away from the intermediate section and being of different lengths to each other, the length of the intermediate section being at least 29% of the overall length of the garment, the garment having an overall length of 25" to 70" and an overall width of $\frac{5}{8}$" to $8\frac{1}{2}$".

Preferably the outer sections are of similar shapes.

A garment in accordance with this invention has many uses and is desirably made from crease resistant material and designed to be carried in a handbag or pocket.

Examples of uses are as follows:

1. Hair tie for holding hair in place;
2. Headband for hair tie and for decorative and hair tying use;
3. Cincture for creating a waisted look on garments to increase the number of shapes a garment can have when worn;
4. Variable size decorative cincture;
5. Neck-wear garment, which because of the similar shapes of the two outer sections, is usable for holding together the edges of non-fastened fronts and collars of blouses, dresses, shirts, jumpers, rain-wear and top-coats and for decorative wear on fastened blouses, dresses, shirts, jumpers, rain-wear and top-coats;
6. A multi-use adornment accessory for use as a wrist wear adornment or a hand-bag adornment;
7. A multi-use emergency and support tie garment for use as a swimming support tie or for strapless bikini tops and as a general emergency tie.

All these uses are possible because of the shape of the garment as set out above.

The two outer sections are preferably shaped and finished to be displayed.

The intermediate section should be unpleated.

DESCRIPTION OF THE PREFERRED EMBODIMENTS

Figure 1:
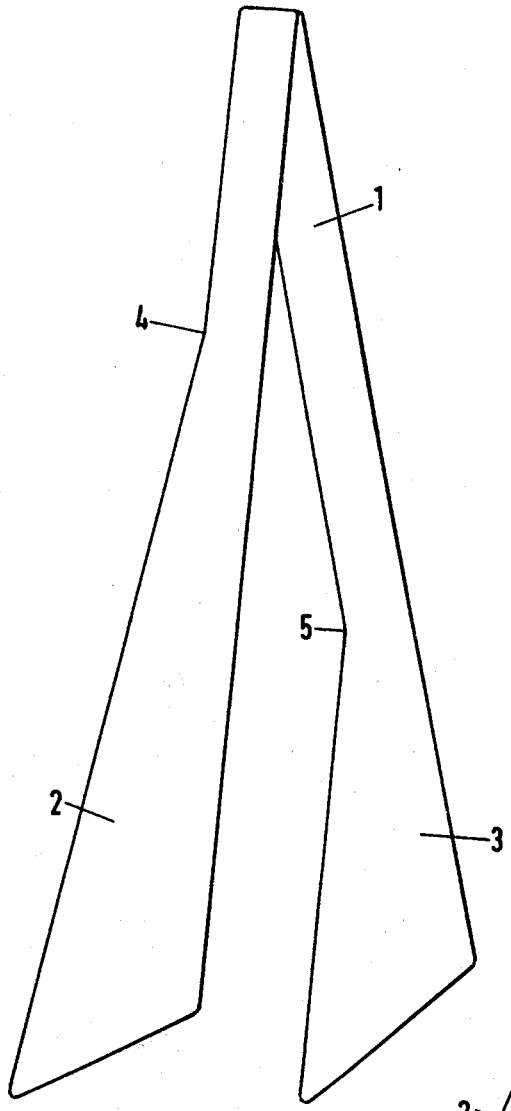
FIGS. 1 and 2 are outline drawings of two garments in accordance with this invention.
Figure 2:
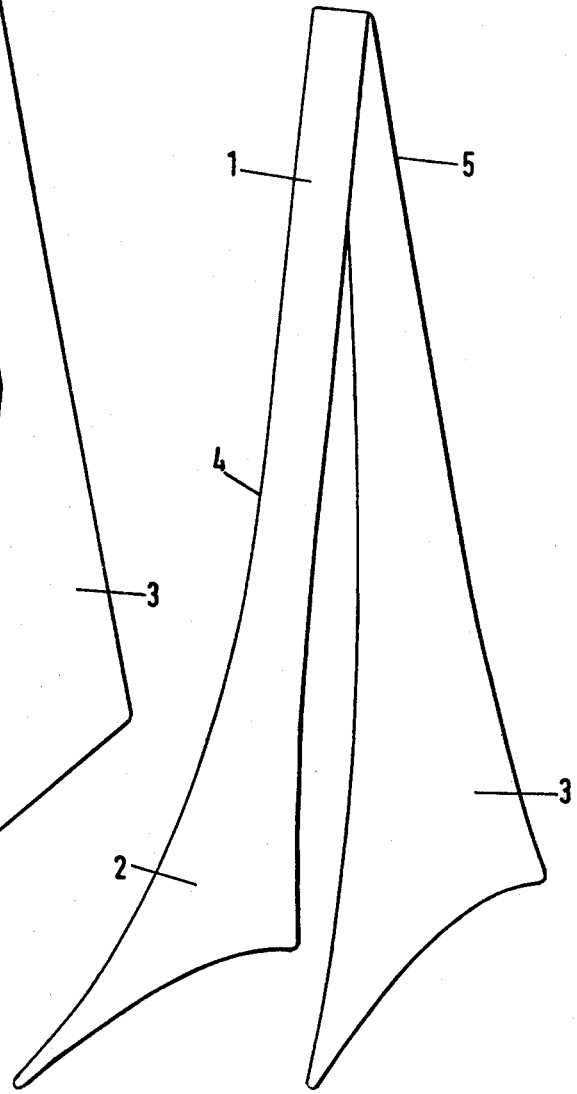
Figure 3:
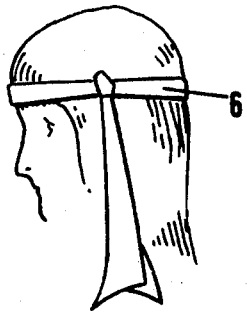
FIGS. 3 to 10 are views illustrating the use of the garments in accordance with this invention.
Figure 4:
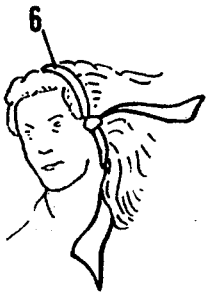
Figure 5:
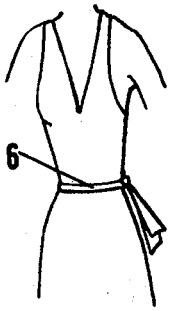
Figure 6:
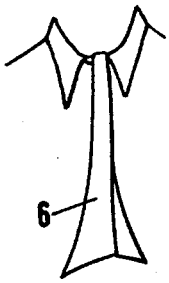
Figure 7:
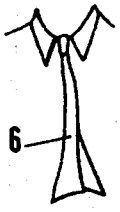
Figure 8:
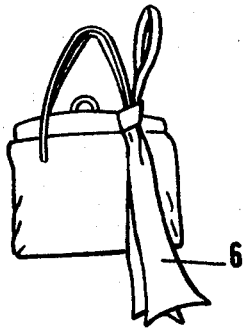
Figure 9:
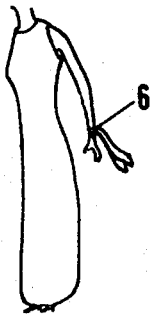
Figure 10:
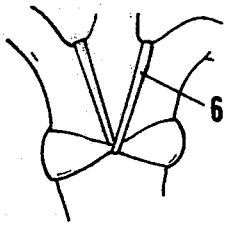

In FIGS. 1 and 2, the intermediate section is denoted by 1 and the outer sections by 2 and 3; numerals 4 and 5 denote the ends of the intermediate section. When laid out flat the intermediate section 1 is not central and the outer sections 2 and 3 have different lengths.

The garment will be offered in different sizes and the correct size for a woman is obtained by adding her waist and head measurements in inches together and dividing the total by three. For example, if the woman's head measurement is 23" and her waist measurement is 26" this gives a figure of 16.33 which is a number corresponding to the medium size.

The small size corresponds to up to 13 on the above calculation, the medium size to between 14 and 17 on the above calculation and the large size to 18" and above on the above calculation.

The minimum length of the garment is 25" which corresponds to an intermediate section length of say 8" and an intermediate section width of $\frac{5}{8}$". The maximum size which has been attempted is 70" long having an intermediate section length of 24" and a width of $1\frac{1}{2}$".

The overall width which lies between $\frac{5}{8}$" and $8\frac{1}{2}$" gives a wide range for commercial exploitation.

The garment may be manufactured from a folded strip of material and may have an inner lining.

In FIGS. 3 to 10 the garment is denoted at 6 and these Figures are self-explanatory.

I claim:

1. A garment for women and girls which is elongate, has no longitudinal axis of symmetry, and has an intermediate section of constant width and two outer sections which are of different shape, the outher sections increasing in width initially as they extend away from the intermediate section being of different lengths to each other, the length of the intermediate section being at least 29% of the overall length of the garment, the garment having an overall length of 25" to 70" and overall width of $\frac{5}{8}$" to $8\frac{1}{2}$".

2. A garment as claimed in claim 1 wherein the two outer sections are shaped and finished to be displayed.

3. A garment as claimed in claim 1 wherein the intermediate section is unpleated.

4. A garment as claimed in claim 2 wherein the intermediate section is unpleated.

* * * * *